US005933876A

United States Patent [19]

Simonds

[11] Patent Number: 5,933,876

[45] Date of Patent: Aug. 10, 1999

[54] SANITARY CLIP-ON HANDLE

[76] Inventor: James Simonds, 630 Thomas St., Coopersburg, Pa. 18036

[21] Appl. No.: 09/073,321

[22] Filed: May 4, 1998

[51] Int. Cl.[6] ..... A47K 13/10

[52] U.S. Cl. ..... 4/246.1; 16/114 R

[58] Field of Search ..... 4/246.1; D48/300, D48/301, 305, 321; 16/114 R

[56] References Cited

U.S. PATENT DOCUMENTS

| | | | |
|---|---|---|---|
| D. 324,161 | 2/1992 | Mac Ritchie | D8/307 |
| D. 351,550 | 10/1994 | Clark | D8/307 |
| 3,191,193 | 6/1965 | Bogenberger | 4/246.1 |
| 3,935,601 | 2/1976 | Hermann | 4/251 |
| 4,805,246 | 2/1989 | De Vargas | 4/251 |
| 4,951,324 | 8/1990 | Lirette | 4/251 |
| 5,086,523 | 2/1992 | De Mott | 4/251 |
| 5,375,267 | 12/1994 | Davis | 4/246.1 |
| 5,590,425 | 1/1997 | Janik | 4/246.1 |
| 5,619,758 | 4/1997 | Burkett | 4/246.1 |

*Primary Examiner*—Charles E. Phillips
*Attorney, Agent, or Firm*—Goldstein & Canino

[57] ABSTRACT

A sanitary clip-on handle arrangement that may be clipped onto a toilet seat when needed by a user. The clip-on handle includes a handle portion that is fixed to a clip portion. The clip portion provides a clamping arrangement that may be operated by a user to enable the clip-on handle to be temporarily clipped onto a hinge mounted toilet seat for use in lifting and lowering the toilet seat. The handle portion may be rotatably fixed to the clip portion to be movable between a first extended position enabling a person to easily grasp the handle portion and a second tucked position that is less obtrusive.

4 Claims, 3 Drawing Sheets

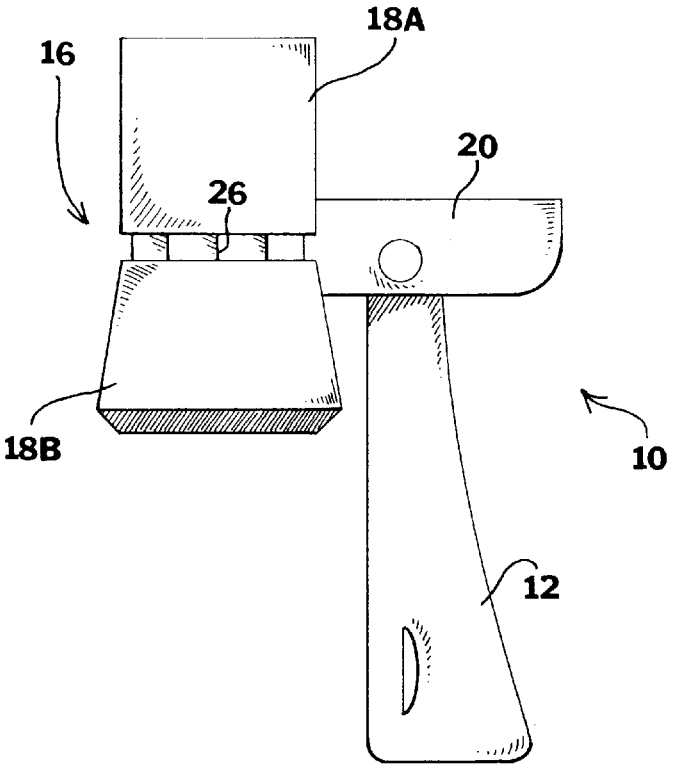
FIG. 3A
FIG. 3B
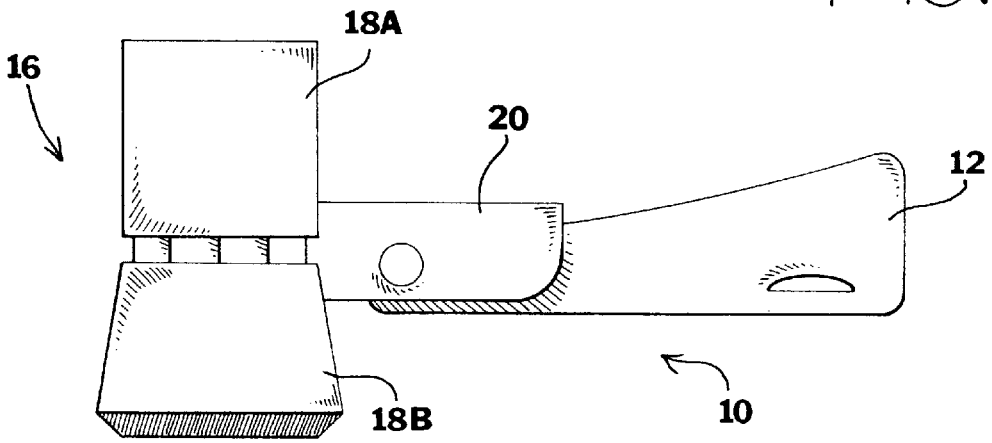

SANITARY CLIP-ON HANDLE

BACKGROUND OF THE INVENTION

1. Field of the Invention

The invention relates generally to sanitary and convenience devices. More particularly, the present invention relates to a sanitary clip-on handle for use in lifting and lowering a toilet seat to minimize the contacting by a user of unsanitary surfaces of a toilet.

2. Background and Objects of the Invention

The need to use public or common restroom facilities results in a user contacting surfaces, including toilet seats, etc., wherein the contacted surfaces may be contaminated with urine, feces, and or a variety of germ and micro organisms. In cases where such facilities must be used, it is desirable to reduce or minimize the contacting of such surfaces.

A variety of prior art devices have been proposed that are specifically provided and configured for fixed (permanent) attachment to a toilet seat. For example, U.S. Pat. No. 3,935,601 to Hermann, provides a device that is fixed to the toilet seat preferably via screws or double sided tape. Other similar devices are provided in U.S. Pat. Nos. D324,161 and D351,550, to MacRitchie and Clark et al., respectively. These devices, along with others known in the art, provide a means to lift a toilet seat without having to touch the actual surfaces of the seat. However, once fixed to the toilet seat, such devices are certainly likely to be contaminated in the same manner that the toilet seat itself is. At minimum, some contamination may be expected. Further such devices can not be easily removed from the toilet seat when the seat requires cleaning, or the lifting device may require cleaning. As these devices are permanently fixed to the toilet seat, they also represent a possible hazard since each extends outwardly from the seat and can be easily walked or moved into.

Another device known in the art that is partially removable is provided by U.S. Pat. No. 5,086,523 to De Mott et al. This device includes two major portions. The first portion is fixed to the under side of the toilet seat, while the second portion, which is tab-like in shape with a hole provided in one end. The second portion is arranged slide into the first portion and further includes a deodorizing means. This device suffers from many of the drawbacks discussed above. In addition, the inclusion of a deodorizing means is not desired or consistent with the function and structure of the present invention.

Objects of the present invention are, therefore, to provide new and improved sanitary toilet seat lifting and lowering devices having one or more of the following capabilities, features, characteristics, and/or advantages:

- configured with a clamping portion to clip or clamp onto a toilet seat when in use, and be easily removed therefrom when not being used;
- may be easily carried in a pocket, handbag, and the like, and attached to a toilet seat when required;
- includes a rounded, elongated, and preferably foldable handle portion;
- the handle portion may be configured to be movable between a first extended position enabling a person to easily grasp the handle portion and a second tucked position wherein the handle portion is less obtrusive; and
- having a simple low cost construction.

The above listed objects, advantages, and associated novel features of the present invention, as well as others, will become more clear with a careful review of the description and figures provided herein. Attention is called to the fact, however, that the drawings and the associated description are illustrative only, and variations are certainly possible.

SUMMARY OF THE INVENTION

In accordance with the present invention a clip-on handle arrangement is provided that may be clipped onto a hinge mounted toilet seat to assist a user in raising and lowering the toilet seat, and subsequently quickly and easily removed therefrom. The clip-on handle comprises a handle portion with a clip portion suitably fixed to, or coupled to, the handle portion. The clip portion is arranged to have a clamping arrangement that may be operated by a user and moved into an open position, and when released by the user is biased to a closed position for suitably clipping onto the toilet seat. Accordingly, the clip-on handle is configured to be temporarily clipped onto the toilet seat for use in lifting and lowering the seat, and may be quickly removed therefrom by the user appropriately grasping and operating the clip portion into the open position, thereby releasing the clip-on handle arrangement from the toilet seat.

In a preferred embodiment of the invention the handle portion is movably or rotatably fixed to the clip portion to enable the handle portion to be moved into in either a first extended position enabling a person to easily grasp the handle portion and a second tucked, less obtrusive position wherein the handle portion extends substantially parallel to, and along an outer edge of the toilet seat.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of many possible arrangements utilizing the fundamental concepts of the present invention. The drawings are briefly described as follows:

FIGS. 3A and 3B illustrate the clip-on handle in a first extended position and a second tucked position, respectively.

LIST OF REFERENCE NUMERALS USED IN THE DRAWINGS

10—clip-on handle
12—(elongated) handle portion
16—clip portion
18—clamp members
18*a*—clamping end (of clamp members)
18*b*—tab end (of clamp members)
20—support member
24—spring or bias arrangement
26—hinge means
30—rubberized patch (or patches)

DETAILED DESCRIPTION OF THE PREFERRED EMBODIMENTS

It is important to establish the definition of several terms and expressions that will be used throughout this disclosure. The expressions 'clip-on handle','clip-on handle arrangement', 'handle clip', and 'sanitary clip-on handle', are equivalents that will be used interchangeably in the following disclosure. The expressions 'clip means' and 'clip portion' are also to be defined as equivalents and are intended to indicate any arrangement that may be employed to enable a user to quickly, easily, and somewhat firmly attach the clip-on handle of the present invention to a (hinge mounted) toilet seat. As skilled individuals will appreciate, the toilet seat may be configured as a single hinged ring that may be lifted and lowered, or alternately, the toilet seat may comprise a ring portion with a lid portion that may be positioned (in a lowered position) so as to substantially cover the ring portion. Accordingly, with either the former of the latter toilet seat configurations, the clip-on handle of the present invention is contemplated to be clipped onto either portion of the toilet seat. Additional terms and expressions will be defined below as needed.

Figure 1:
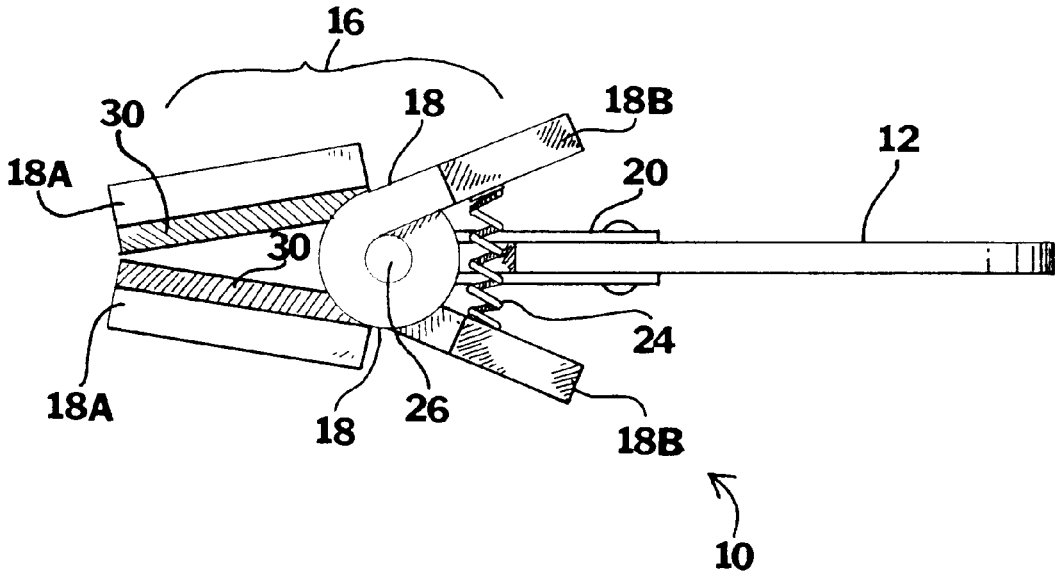
FIG. 1 provides a profile or side view of an embodiment of the sanitary clip-on handle of the present invention.
Figure 2:
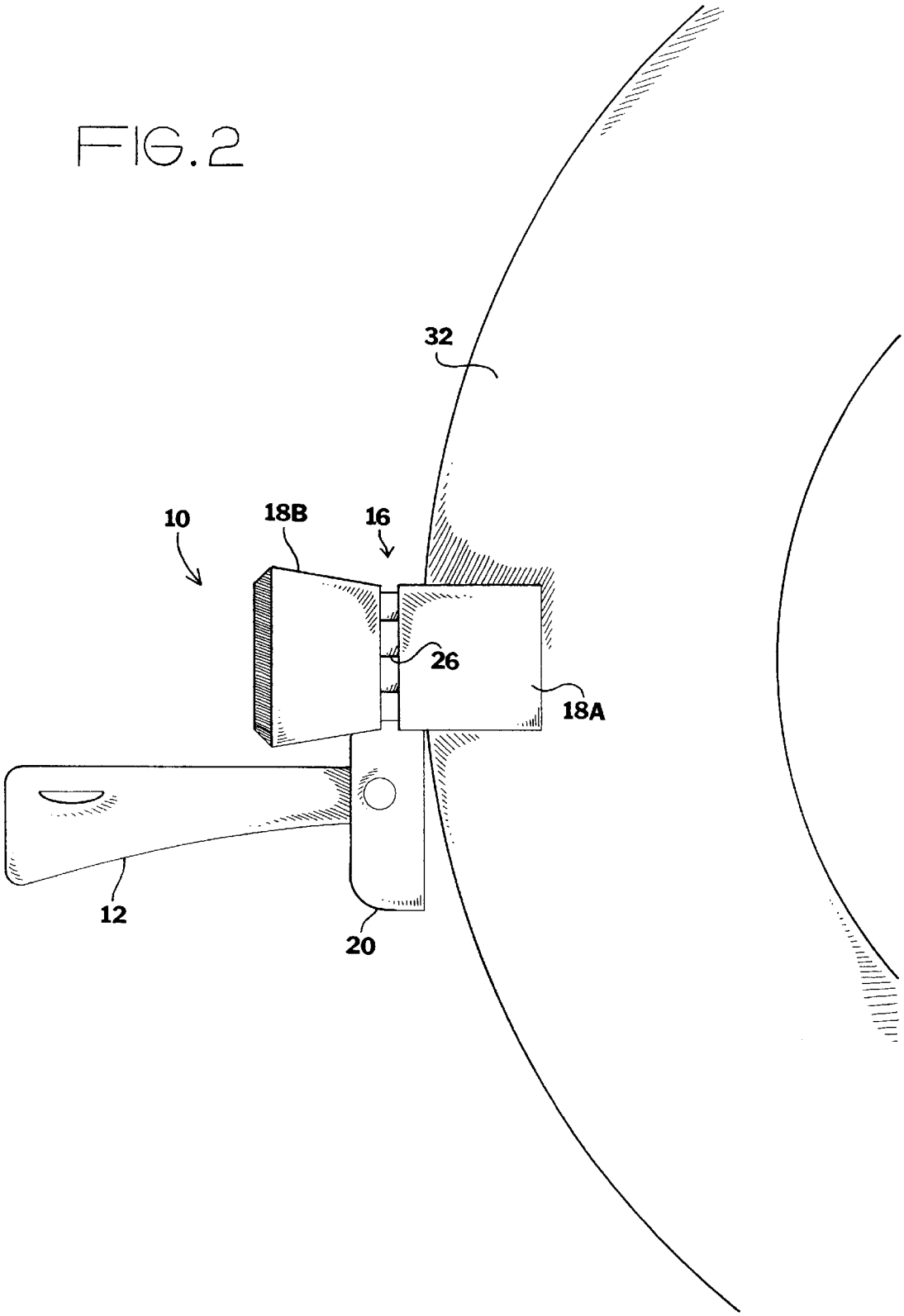
FIG. 2 depicts a plan view of the clip-on handle clamped onto (a ring of) a toilet seat and available for use.

Referring now to FIG. 1, there is depicted a side view of an embodiment of the sanitary clip-on handle 10 of the present invention. As can be seen therein, a handle portion 12, which may preferably be elongated, is suitably coupled to a clip means, such as clip portion 16. The clip portion 16 is configured to enable the clip-on handle 10 to be temporarily clipped (or clamped) onto the toilet seat 32 (as seen in FIG. 2) for use in lifting and lowering the toilet seat 32. Therefore, the inclusion of a properly configured clip portion 16 clearly enables the clip-on handle 10 to be quickly attached to, or removed from, the toilet seat 32 by the user.

As can be seen in FIGS. 1 and 2, the embodiment of the chip portion 16 illustrated therein may be comprised of a plurality of opposing clamp members 18 (two members as depicted) that are rotatably fixed proximal to the center of each clamp member 18. For example, a hinge means 26 may be included to rotatably couple or fix the clamp members 18, as can be seen in either of FIG. 1 or FIG. 2. Accordingly, the clamp members 18, each of which has a clamping end 18*a* and a tab end 18*b*, may be operated by a user (via the tab end 18*b*) and moved into an open position wherein the clamping ends are spaced to enable the clip portion 16 to be suitably positioned with the toilet seat 32 between the clamping ends 18*a*. When subsequently released by the user, the clip portion 16 assumes a closed position suitably clamping or clipping the clip-handle 10 onto the toilet seat 32, as shown in FIG. 2. It may be noted that the term "suitably positioned" is intended to indicate the positioning of the clip portion 16 in a manner as shown in FIG. 2, wherein the clamping ends 18*a* of the clip portion 16 may somewhat firmly clamp onto the toilet seat 32 (when released). Thus, by a user appropriately grasping and operating the tab ends 18*b* of the clamp members 18, the clip portion 16 may be placed or moved into an open position, suitably positioned with the toilet seat 32 between the clamping ends 18*a*, and then released by the user so that the clamping ends 18*a* clamp the clip-on handle 10 onto the toilet seat 32.

As can be seen in FIGS. 3A and 3B, the handle portion 12 of the present invention may preferably be suitably coupled to the clip portion 16 so as to enable the handle portion 12 to be movable between either a first extended position enabling a person to easily grasp the handle portion 12 (to lift and lower the toilet seat 32) and a second tucked, less obtrusive position. When in the second position, the handle portion 12 extends substantially parallel to, and possibly abutting, an outer edge of the toilet seat 32. This feature is important because it enables the handle portion 12 to be folded and moved out of the way, if desired by a user. It is important to note a support member 20 represents an exemplary manner in which the handle portion 12 and the clip portion 16 may be "coupled". Further, skilled persons will recognize that the support member 20, as best seen in FIGS. 2, 3A and 3B, is configured to enable the handle portion 12 to be tucked (as shown in FIG. 3B) in a single direction. This need not be the case as the support member 20 may be modified to enable the handle portion 12 to swivel in either direction if necessary or desired. However, in a preferred embodiment of the present invention the handle portion 12 and the clip portion 16 are permanently coupled (e.g., rotatably fixed) to each other.

Referring again to the embodiment of FIG. 1, the opposing clamp members 18 are shown rotatably fixed proximal to the center of each clamp member 18 with the clip portion 16 having a spring 24, which may be termed a biasing means, provided to bias the clamp members to the closed position when not being operated by a user. The spring 24 represents one arrangement that may be provided to bias the clamp members to the closed position. Also best seen in FIG. 1, on an inner surface of each clamping end 18*a* of each clamp member 18 are rubberized patches 30 that are secured to the inner surfaces to enable the clip portion 16 to more securely and firmly hold the clip-on handle 10 on the toilet seat 32.

An important feature of the preferred embodiments of the invention is the ability of a user to temporarily (and rapidly) clip the clip-on handle 10 onto a hinge mounted toilet seat 32 for use in lifting and lowering the toilet seat, and subsequently enabling the user to quickly remove the present invention from the toilet seat. As such, it is contemplated that the user may carry the clip-on handle 10, say in a pocket or a handbag, until needed for use. The handle may then be clipped onto a toilet seat and used as needed, and subsequently unclipped and washed (if necessary) before being stored away. Accordingly, a most preferred embodiment of the present invention would be configured to compact, lightweight, and very portable.

It is important to understand that the description of the embodiments of the clip-on handle 10 of the present invention are illustrative only, and other equivalent arrangements are certainly possible. For example, the clip portion 16 of the present invention may be provided in many varying forms. Therefore, while there have been described the currently preferred embodiments of the present invention, those skilled in the art will recognize that other and further modifications may be made without departing from the present invention, and it is intended to claim all modifications and variations as fall within the scope of the appended claims.

What is claimed is:

1. A clip-on handle arrangement that may be clipped onto a hinge mounted toilet seat and later removed, comprising:

a) handle portion that is movable coupled to a clip portion to enable the handle portion to be moved in either a first extended position enabling a person to easily grasp the handle portion and a second tucked, less obtrusive position wherein the handle portion extends substantially parallel to and along an outer edge of the toilet seat;

b) a clip portion that is suitably coupled to the handle portion, the clip portion having a clamping arrangement that may be operated by a user and moved into an open position, and when released by the user is biased to a closed position for clipping onto the toilet seat;

c) the clip portion further comprising a plurality of opposing clamp members that are rotatably fixed proximal to the center of each clamp member, the clip portion including a bias means that is provided to bias the clamp members to the closed position, each clamp member having a tab end for operating the clip portion into the open position and a clamping end for clipping onto the toilet seat;

d) the clip-on handle arrangement configured to be temporarily clipped onto the toilet seat for use in lifting and lowering the toilet seat, and may be quickly removed therefrom by the user by appropriately grasping and operating the clip portion into the open position, thereby releasing the clip-on handle arrangement from the toilet seat.

2. The clip-on handle arrangement according to claim 1, wherein an inner surface of each clamping end of each clamp member has secured thereto a rubberized patch provided to more securely hold the clip-on handle arrangement to the toilet seat.

3. A sanitary handle clip that may be clipped onto a toilet seat and later removed, the handle clip comprising:

a) an elongated handle portion; and b) a clip portion coupled to the handle portion, the clip portion having opposing elongated clamp members that are movable to an open position by a user and when released thereby are biased into a closed position to clamp onto a toilet seat when suitably positioned before release;

c) the opposing clamp members suitably hinged with a spring provided to bias the clamp members in the closed position, each clamp member comprised of a tab end and a clamping end, with an inner surface of each clamping end having secured thereto a rubberized patch provided to more securely hold the handle clip to the toilet seat when clamped thereon; and d) the handle clip arranged to be temporarily clipped onto a hinge mounted toilet seat for use in lifting and lowering the toilet seat, and may be quickly removed therefrom by the user by grasping and operating the clip portion into the open position, thereby releasing the handle clip from the toilet seat.

4. The handle clip according to claim 3, wherein the handle portion is rotatably coupled to the clip portion to enable the handle portion to be movable between a first extended position enabling a person to easily grasp the handle portion and a second tucked position wherein the handle portion is less obtrusive and extends substantially parallel to and along a portion of an outer edge of the toilet seat.

* * * * *